US006169852B1

(12) United States Patent
Liao et al.

(10) Patent No.: US 6,169,852 B1
(45) Date of Patent: Jan. 2, 2001

(54) RAPID VAPOR GENERATOR

(75) Inventors: Qiang Liao; Tianshou Zhao; Ping Cheng, all of Kowloon (HK)

(73) Assignee: The Hong Kong University of Science & Technology (HK)

( * ) Notice: Under 35 U.S.C. 154(b), the term of this patent shall be extended for 0 days.

(21) Appl. No.: 09/294,133

(22) Filed: Apr. 20, 1999

(51) Int. Cl.[7] ..... F24F 6/08; F02H 15/04; B01D 47/16

(52) U.S. Cl. ..... 392/395; 261/142; 261/94

(58) Field of Search ..... 392/386, 390, 392/394, 395, 400, 401, 402, 403, 405, 406; 261/142, 66, 68, 94, 99, DIG. 65; 122/366

(56) References Cited

U.S. PATENT DOCUMENTS

| | | | | |
|---|---|---|---|---|
| 1,944,821 | | 1/1934 | Blaise | 392/395 |
| 2,519,515 | | 8/1950 | Turner | 392/395 |
| 3,660,635 | | 5/1972 | Liebert | 392/387 |
| 3,672,568 | * | 6/1972 | Foote . | |
| 4,020,321 | * | 4/1977 | Oswald . | |
| 4,110,419 | | 8/1978 | Miller | 261/142 |
| 4,266,116 | * | 5/1981 | Bauer et al. . | |
| 4,491,146 | | 1/1985 | Sveds | 137/341 |
| 4,748,314 | * | 5/1988 | Desage . | |
| 4,924,068 | * | 5/1990 | Henri . | |
| 5,014,337 | * | 5/1991 | Desage . | |
| 5,484,086 | | 1/1996 | Pu | 392/395 |
| 5,602,958 | | 2/1997 | Vergnes | 392/395 |
| 5,692,095 | | 11/1997 | Young | 392/395 |

* cited by examiner

*Primary Examiner*—Sang Paik
(74) *Attorney, Agent, or Firm*—Burns, Doane, Swecker & Mathis, L.L.P.

(57) ABSTRACT

The invention relates to an electrically-energized device for the rapid generation of steam or other vapors. The high-speed steam generator includes a wicked evaporator, a liquid reservoir, a liquid supply pipe, and a vapor transport tube. The evaporator consists of a low-thermal-conductivity porous wick, heated from a downward-facing grooved heating block that is in intimate contact with the upper surface of the wick structure. The grooved heating block is made of a copper block in which electric cartridge heaters are installed. As a heat load is applied on the heating block, an extremely steep temperature gradient is established immediately at the upper surface of the wick so that water from the saturated wick evaporates rapidly adjacent to the heated surface. Subsequently, menisci are formed at the vapor/liquid interface to develop a capillary force to pump subcooled liquid into the wick from the liquid reservoir. A plurality of grooves in the heating block allow the resulting vapor to instantaneously escape from the heated surface so that a high heat transfer rate from the heating block to the saturated wick can be maintained at all time.

12 Claims, 7 Drawing Sheets

RAPID VAPOR GENERATOR

FIELD OF THE INVENTION

The present invention relates to apparatus for the rapid vaporization of a subcooled liquid, and more specifically, to a rapid vapor generators, as may be used in humidity control, steam cooking, steam hair setting, steam skin therapy, steam iron, and the like.

BACKGROUND OF THE INVENTION

There are many circumstances in which, it is desirable to produce saturated or superheated steam instantaneously. For instance, the control of the humidity in an air-conditioned space usually requires a steam supply to have a fast startup and cut-off response. Other circumstances in which it is desirable to obtain steam instantaneously include steam body and skin therapy, steam cooking, steam hair setting, and steam iron. Further applications of high speed steam generators include steam boilers and vapor generators in other technological and engineering processes.

An electrically-energized steam generator is usually designed such that one or more electric heaters are immersed in a water container to heat up subcooled liquid to saturated or superheated vapor. One of the major drawbacks of such a design is that it takes a rather long time for subcooled water to be vaporized because the process of heating up a large volume of water in the whole container from the subcooled liquid state to the saturated state is usually slow. In order to generate steam instantaneously, in some applications the water in the container has to be maintained at the saturated state by heaters at all times. As will be apparent, this will cause an extra consumption of energy due to the heat losses to ambient.

A variety of techniques have been developed to speed up the vaporization of liquid in a vapor generator. The most relevant technique to the present invention is to use a porous body as the evaporating surface. Examples of the porous-media steam generators can be found U.S. Pat. No. 3,672,568, U.S. Pat. No. 4,020,321, U.S. Pat. No. 4,266,116, U.S. Pat. No. 4,748,314, U.S. Pat. No. 4,924,068, and U.S. Pat. No. 5,014,337. One prior art device (such as U.S. Pat. No. 3,672,568 and U.S. Pat. No. 4,924,068) consists of one or several electrical heaters housed in a porous body plunged wholly or partially in the liquid to be vaporized. When the liquid impregnated in the porous body is heated by the heaters to the boiling point, vapor is generated therein and, under the effect of capillary force developed in the porous body, migrates from the porous body to the vapor exit. Meanwhile, subcooled liquid is continuously pumped into the porous body. Another prior art device (U.S. Pat. No. 4,020,321, U.S. Pat. No. 4,266,116, U.S. Pat. No. 4,748,314, and U.S. Pat. No. 5,014,337) is the so-called electrode-type which comprises a pair of cylindrical or concentric prismatic electrodes connected to the terminals of an electrical energy source. A porous body, saturated with the saline solution, is clamped by two parallel electrode plates. The saline solution is directly heated by the electrical current passing through it. These two types of porous-media steam generator have a shorter period for the subcooled liquid to reach its boiling point as compared to the steam generator without a porous medium.

However, the reduction of vaporization time is still limited because the whole amount of liquid impregnated in the porous body is needed to be heated up before vaporization. For instance, for one prior art device (U.S. Pat. No. 5,014,337) having a 1.5 kW heating power, it takes 2 minutes for subcooled water at the room temperature to be vaporized. In addition, these two types of steam generators have a large heating surface, leading to a large heat losses to the ambient. Furthermore, the second type of the steam generators usually needs a special device (such as a pump) to impregnate liquid in the porous body. A special consideration is also needed for the problem of electrical insulation because the porous body and the liquid are energized directly. For these reasons, this type of steam generator usually has a rather complicated configuration.

SUMMARY OF THE INVENTION

According to the present invention there is provided a vapor generator comprising, a liquid reservoir, a porous medium in communication with said liquid reservoir, and heating means having a surface in contact with a surface of said porous medium, wherein the surface of said heating means in contact with said porous medium is provided with grooves to allow the escape of generated vapor.

In preferred embodiments of the invention the porous medium is contained within a housing and liquid is supplied to the medium from the reservoir at one end of the housing, and the heating means is supplied at an opposed end of the housing.

Preferably the housing is vertically arranged with the liquid being supplied at a lower end of the housing and the heating means being supplied at an upper end of the housing. In this way as liquid is vaporized at the contact between the porous medium and the heating element, liquid is drawn up through the porous medium and replenished at the bottom.

In a preferred form the heating means comprises a heating block formed with at least one electrical heating element, and wherein a surface of said block is in contact with the porous medium, the contacting surface being formed with a plurality of concentric grooves, and at least one radial groove interconnecting said concentric grooves, and the outermost of the concentric grooves being formed with a vapor discharge exit.

The heating element may be any form of suitable electrical heating element, such as for example a cartridge heating element or a film heating element. Means may be provided for controlling the power to the heating element so that at the start of operation it is run at a high power rating, and then subsequently at a lower power rating.

When the porous medium is disposed within a vertical housing, it may either extend not for the full height of the housing in which case a space will be defined beneath the porous medium for the supply of liquid, or it may extend for the full height of the housing and a liquid supply pipe may extend into the porous medium. In either case control means may be provided for maintaining the liquid level in the reservoir between predetermined upper and lower limits.

In another possible embodiment the vertical housing for the porous medium may be such that a lower end of the housing is located directly in the liquid reservoir.

In alternative embodiments of the invention the vapor generator may be tubular in construction. Either a tubular porous medium may be located within a tubular heating element, or conversely a tubular heating element may be located within a tubular porous medium. In either event the surface of the heating element contacting the porous medium is grooved to allow the escape and discharge of generated vapor, and preferably the grooves are axial such that vapor is discharged at an end of the vapor generator.

BRIEF DESCRIPTION OF THE DRAWINGS

Some embodiments of the invention will now be described by way of example and with reference to the drawings in which.

DETAILED DESCRIPTION OF PREFERRED EMBODIMENTS

Figure 1:
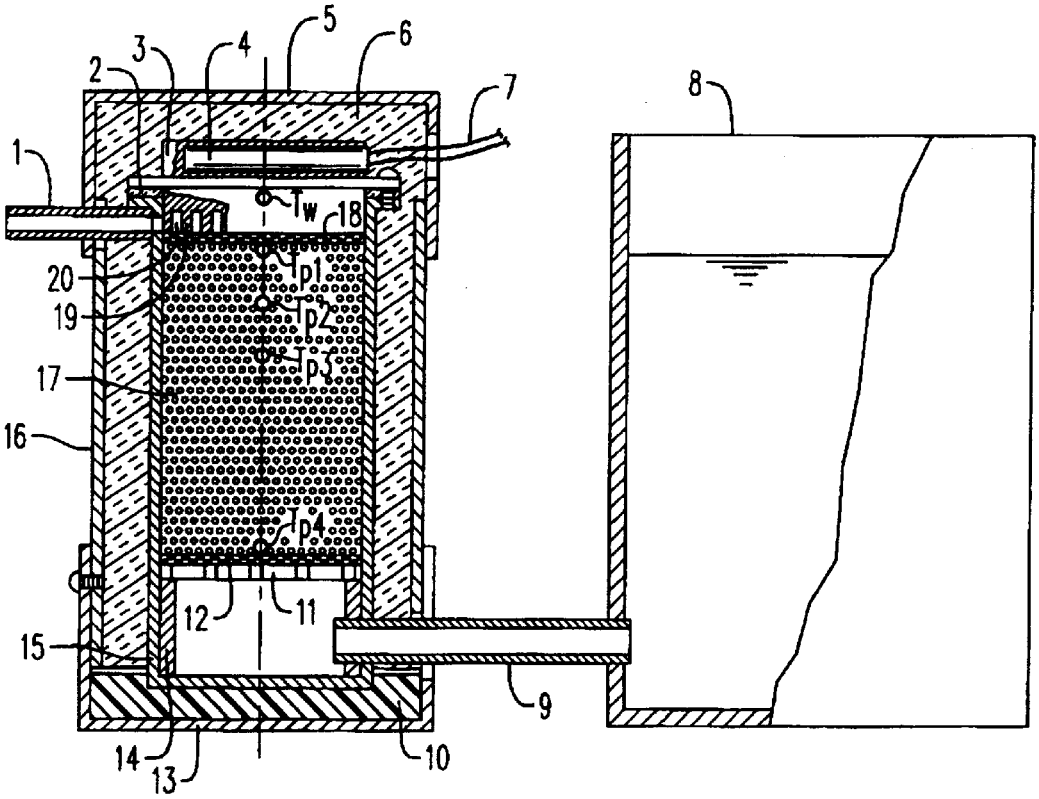
FIG. 1 is a schematic of an overall high-speed steam generator in accordance with one embodiment of the present invention.

A steam generator according to a first embodiment of the present invention consists of three major sub-assemblies: an evaporator, a feedwater container, and an electric circuit for controlling heating power. As shown in FIG. 1, the evaporator comprises a porous body 17, a grooved heating block 3, and a thermal insulator 6. Porous body 17 consists of a vertically-oriented cylindrical housing 15 packed with glass beads of 1.0 mm in diameter. The glass beads are held by a layer of stainless steel screen 12 attached on the top surface of a perforated plate 11, which in turn is supported by a ring 14 located at the bottom of the porous body. Another layer of stainless steel screen 18 is laid on the top of the porous body to prevent the movement of the glass beads. Grooved heating block 3 is placed on the top of the porous body 17, and fin tips 19 of the grooved heating block 3 are in intimate contact with the upper surface of the porous body.

Heatproof washer 2 is installed between the heating block 3 and the housing 15 to prevent the leakage of vapor. Vapor transport tube 1 is soldered on the vertical housing 15 and opens to vapor grooves 20 of the grooved heating block 3. Two cartridge heaters 4 having a total heating power of 230 W are inserted into the grooved heating block 3 and connected with an electrical power supply through the electric wires 7. The whole vertical housing 15 is enclosed by thermal insulator 6 to reduce the heat losses to the ambient. The thermal insulator 6 is encased by the outer shells 5, 13, and 16. The vertical housing 15 is sited on a bakelite base 10 which is in turn held by the outer shell 13.

As shown in FIG. 1, subcooled water is continuously fed from said feedwater container 8 standing adjacent to the evaporator through a feedwater tube 9.

Figure 2A:
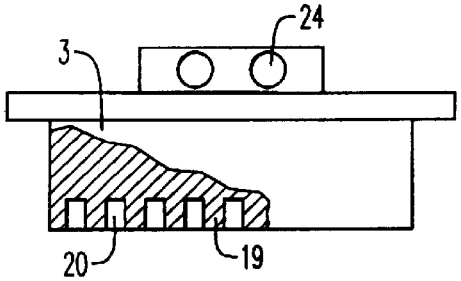
FIGS. 2*a*, 2*b* and 2*c* show the front, the side, and the bottom views of the grooved heating block according to the embodiment shown in FIG. 1.
Figure 2B:
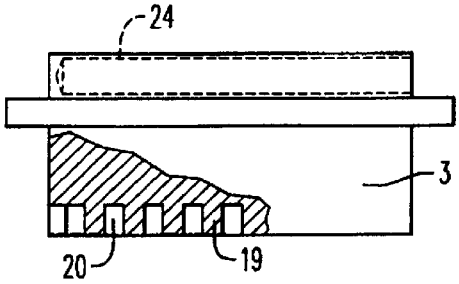
Figure 2C:
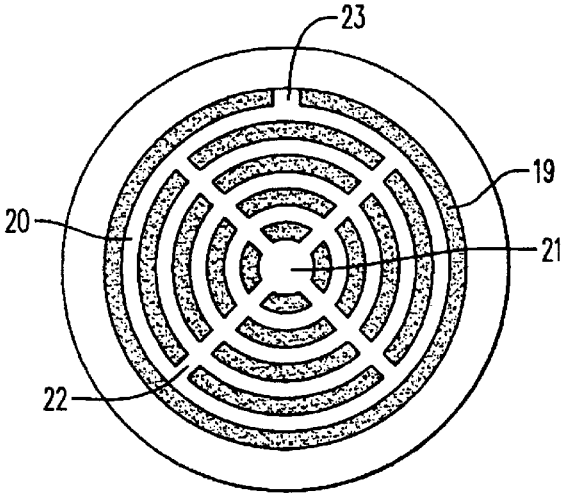

To show more details of the grooved heating block 3 of the embodiment shown in FIG. 1, the front, the side, and the bottom views of the grooved heating block 3 are illustrated in FIG. 2*a*, 2*b* and 2*c*, respectively. As seen from FIG. 2*c*, five concentric circular extrusion fins 19 of 2.5 mm in width and 3 mm in height are formed by grooving the bottom surface of the heating block 3 with an outside diameter of 50 mm. The thus-formed grooves 20 are interconnected by the two radial grooves 22. A cut 23 of 6 mm in width and 3 mm in depth in the outside fin leads vapor to the vapor exit. As shown in both FIG. 2*a* and 2*b*, two holes 24 are drilled in the upper portion of the grooved heating block 3 for installing the two cartridge heaters 4.

Before heating, the water level in the feedwater container 8 is kept such that the whole porous body 17 is saturated with subcooled water. Once a heat load is applied, the temperature of liquid in the vicinity of the fin tips the grooved heating block 3 increases rapidly to boiling point. Subsequently, vapor is generated and drains out through the vapor grooves 20 and the vapor exit 23 to the vapor transport tube 1. Driven by the capillary force developed in the upper surface of the porous body 17, subcooled water is pumped from the feedwater container 8 to replenish the heated fin surfaces 19.

Figure 3:
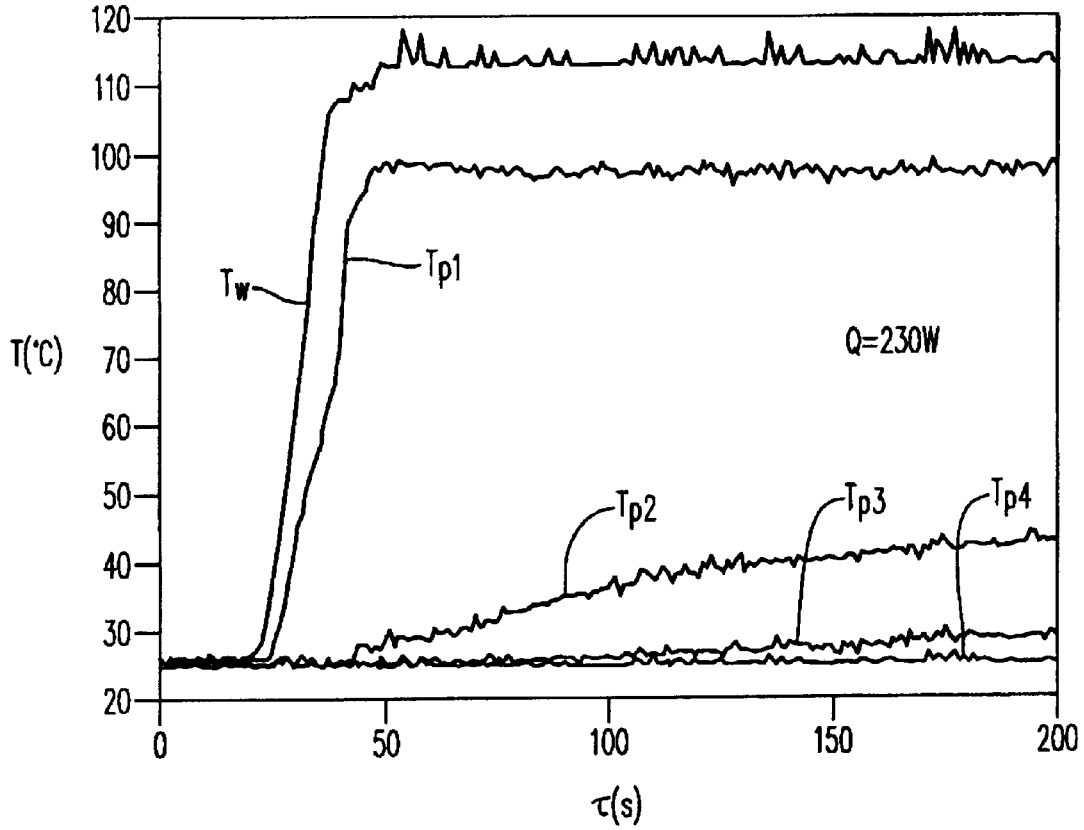
FIG. 3 is a diagram illustrating the time-dependent temperatures at the heating block and at various elevations of the porous body according to the embodiment shown in FIG. 1.

To test the device performance of the embodiment of the present invention shown in FIG. 1, the temperatures at both the heating block and at the porous body were measured. As illustrated in FIG. 1, along the centerline of the porous body 17, four thermocouples ($T_{p1}$, $T_{p2}$, $T_{p3}$, and $T_{p4}$) were installed at different elevations: 2 mm, 10 mm, 20 mm, and 60 mm away from the upper surface of the porous body 17. The measured temperatures are presented in FIG. 3. It can be seen from FIG. 3 that once the heaters having a total heating power of 230 W are applied to the heating block 3, the temperature near the heated fins ($T_{p1}$) increases very rapidly, taking only 21 seconds from the subcooled water temperature of 25° C. to the saturated vapor temperature. FIG. 3 also shows that the temperatures at the locations away from the upper surface of the porous body 17 increase very slowly. $T_w$ represents the mean temperature of the heating block obtained by averaging the readings of the thermocouples located at the heating block.

Figure 4:
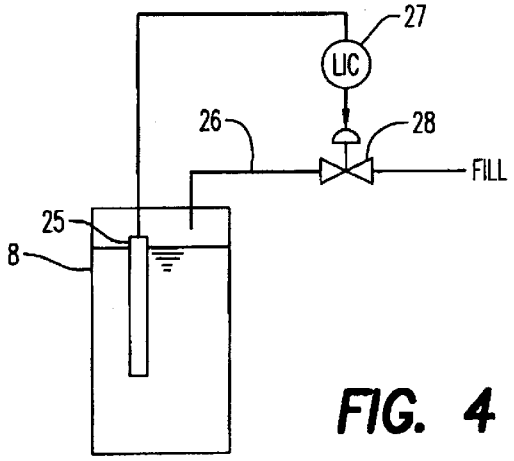
FIG. 4 is a diagram of the liquid level control system for the embodiment shown in FIG. 1.

A water level controller is used to control the water level in the feedwater container 8 such that the water level varies between an upper limit and a lower limit. The upper limit of the water level corresponds to the condition under which the water level in the porous body 17 is just located at the fin/wick interface, whereas the lower limit of the water level refers to the condition under which the evaporator reaches its maximum heat load. As shown in FIG. 4, the water level controller includes a liquid level sensor 25, a controller 27, and a solenoid valve 28. Before the steam generator is energized electrically, the feedwater container 8 is filled up to the upper limit of the water level. During the operation of the steam generator, the water level controller will control the water level in the range of the upper and the lower limits.

Figure 5:
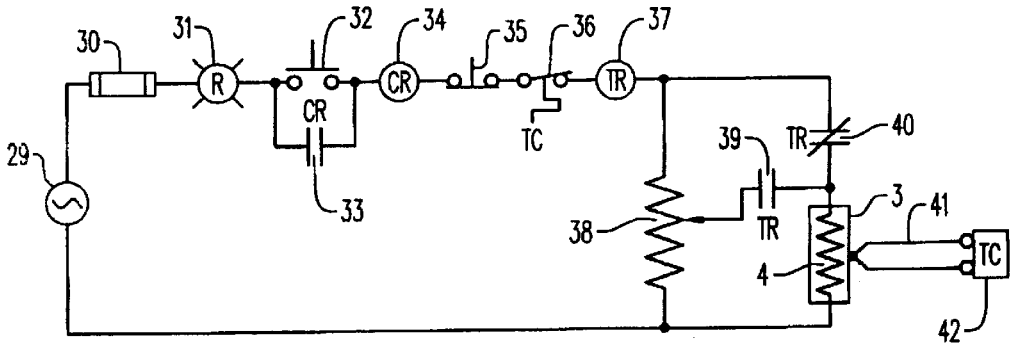
FIG. 5 is a diagram of the electric circuit system for controlling heating power.

The performance of the steam generator can be optimized by controlling the heating power of the heaters 4. For instance, in order to speed up the vaporization of subcooled liquid, it may be preferred that the steam generator operates at the maximum heating power corresponding to the rating voltage of the power supply, then the heating power is adjusted to the desired heating power afterward. An electric circuit for controlling heating power depicted in FIG. 5 serves this purpose. It is seen from this figure that the circuit includes an AC power supply 29, a fuse 30, an indicator 31, a startup switch 32, an relay coil 34 with a normally open relay contact 33, a shut down switch 35, a thermal switch 36 coordinated with a temperature sensor 41, a temperature controller 42 for protecting the heaters 4, an on-delay timer 37 with a normally open relay contact 39 and a normally closed relay contact 40, and a potentiometer 38 for adjusting the heating power of the heaters 4. The switches 32 and 35 coordinating with the relay coil 34 and contact 33 are used to start and shut down the high-speed steam generator. The delay time of liquid vaporization can be tested for a specific steam generator (it is 22 seconds for the device shown in FIG. 1) and can be set through the on-delay timer 37.

When the start switch 32 is on, the heaters 4 will operate at the rating voltage and at the same time the delay timer 37 starts to counter-count the set delay time until the end of the delay time. Then the heating power is automatically adjusted to the desired heating power through potentiometer 38.

Figure 6:
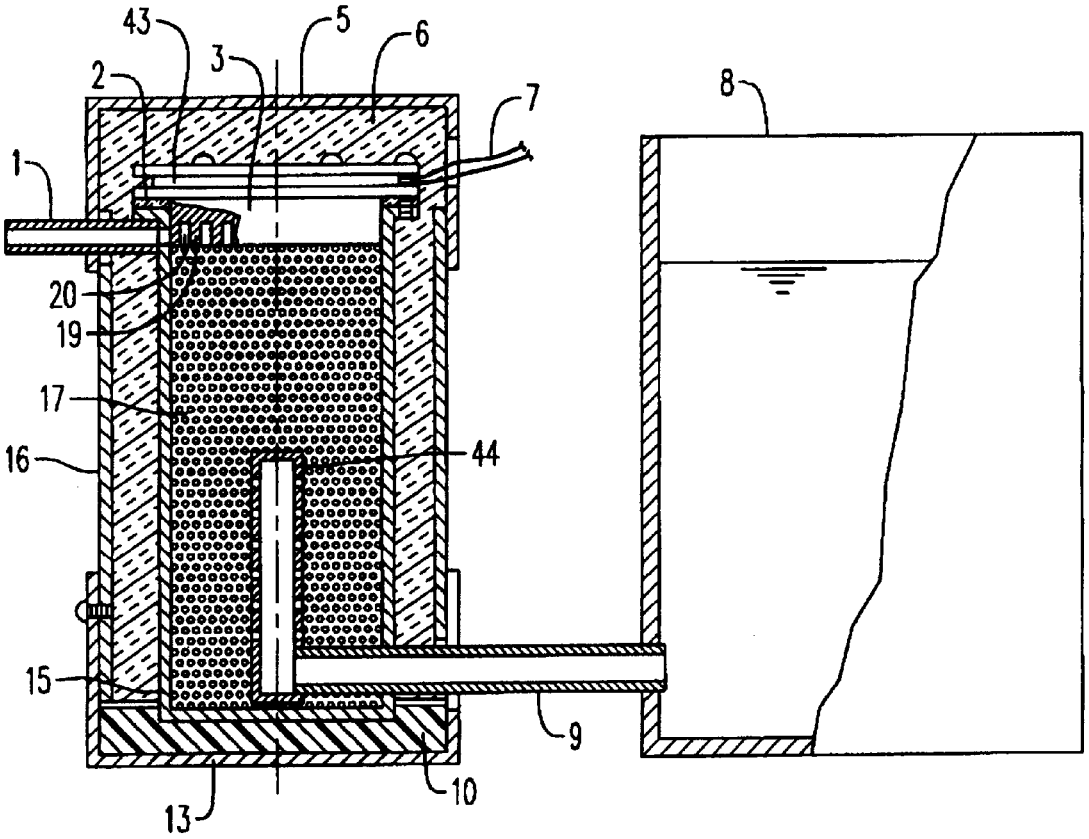
FIG. 6 is a schematic view of a second embodiment.

FIG. 6 shows a second embodiment of the invention in which the porous body 17 fills up the whole vertical housing 15 and cartridge heaters 4 shown in FIG. 1 are replaced by a film heater 43, for instance, stainless steel film or other film heaters, placed on the upward surface of the grooved heating block 3 serving as an alternative heater. It can also be seen from FIG. 6 that a perforated tube 44 is inserted into the porous body 17 to feed subcooled water into the porous body.

Figure 7:
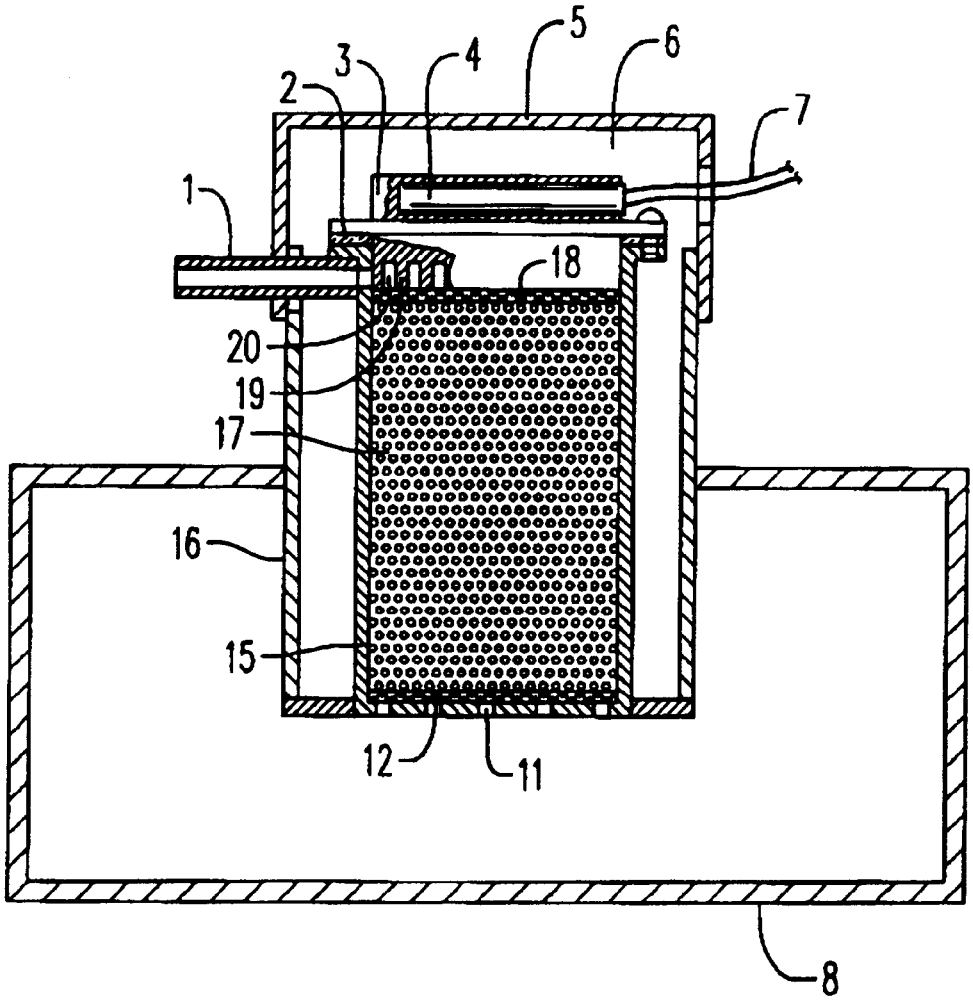
FIG. 7 is a schematic view of a third embodiment.

FIG. 7 illustrates a third embodiment of the invention, in which the porous body 17 is partially immersed in the feedwater container 8 to feed subcooled water without using the feedwater tube 9 shown in FIG. 1.

Figure 8:
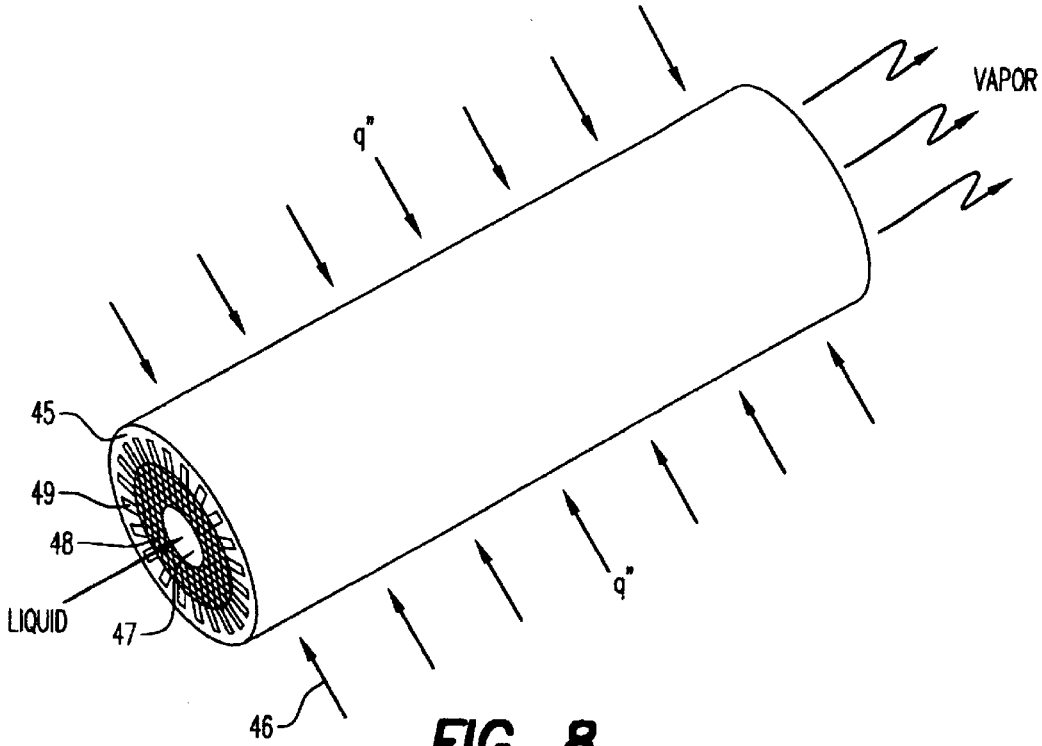
FIG. 8 is a schematic view of a fourth embodiment.

FIG. 8 illustrates a fourth embodiment of the invention. In this embodiment a cylindrical wick 48 encloses a working liquid 47 such as water. An outer cylindrical heat exchanger 45, typically fabricated from aluminum tubing, has a plurality of axially extending vapor grooves 49 formed therein. Liquid flows lengthwise through a passage running along the center of the cylindrical wick 48. Outward-radial liquid flow occurs through the cylindrical wick 48 to the fin tips of the outer cylindrical heat exchanger 45 where heat is applied through a heating element 46, and evaporation occurs. The resulting vapor then drains off through vapor grooves 49 to a vapor transport tube. The outer surface of the heating element 46 should be well insulated to reduce the heat losses.

Figure 9:
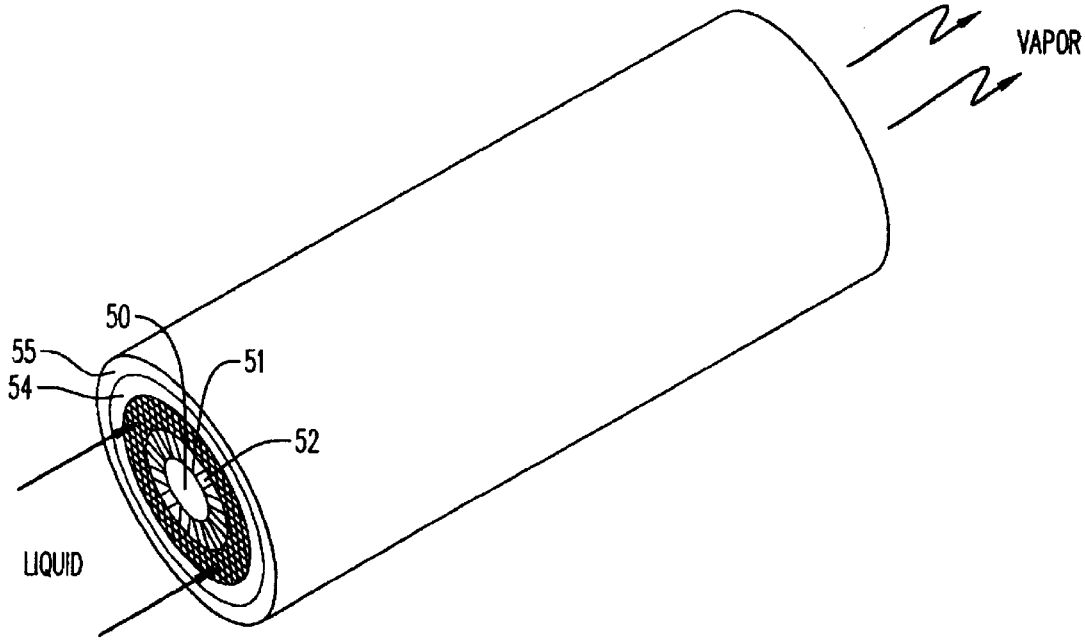
FIG. 9 is a schematic view of a fifth embodiment.

FIG. 9 shows a fifth embodiment of the invention. In this embodiment a cartridge heater is provided having a plurality of axial-fins 50 whose outer surface (i.e., the fin tips) is force-fitted by a tubular porous body 51 housed in a tubular housing 54, which is then enclosed by a tubular thermal insulator 55. Liquid flows lengthwise through the tubular porous body 51. Inward-radial liquid flow occurs through the tubular porous body 51 to the fin tips of the cartridge heater 50 where heat is applied, and evaporation occurs. Vapor then drains off through the grooves 52 to a vapor transport tube.

It should be mentioned herein that the invention is not limited to the embodiments described above and some more suitable modifications can be made without departing from its scope and spirit. For example, the grooved heating block may also be heated by other types of heat sources such as radiation, convective heat transfer of hot fluids, combustion, and the like. In addition, the shapes, the sizes, and the materials of the grooved heating block and the porous body may also be appropriately modified. For example, possible materials for the porous medium include any having a low thermal conductivity and an adequate porosity. Examples include various mineral or natural organic or fibrous synthetic materials, granular materials, sintered materials such as asbestos, glass wool, cellulose fibbers, wool packing, silica and plastics. The heating element may be formed of copper.

At least in its preferred forms the present invention provides very rapid vapor generation. When the heating element is switched on, the temperature of the liquid in the vicinity of the fins formed by the grooves rises rapidly and reaches boiling point in a very short time. This is believed to be because an extremely steep temperature gradient is established between the grooves of the heating element and the porous medium because of the low thermal conductivity of the porous medium. Following vaporization at this surface, menisci are formed to develop a capillary force that draws liquid into the porous medium from the reservoir (without any external pump or the like) to replace that which has evaporated. The grooves formed in the heating element allow the generated vapor to escape immediately so that a high heat transfer rate from the heating element to the porous medium can be maintained all the time. As a result the rate of vapor generation is nearly in a linear relationship with the applied power, implying that the device can assure a precisely controlled supply of vapor. Additionally since the device is only energized when vapor is required, energy consumption is minimised.

What is claimed is:

1. A vapor generator, comprising:

a vertically disposed housing;

a porous medium contained within said housing;

a liquid reservoir from which liquid is supplied to said medium at a lower end of said housing; and a heating means provided at an upper end of said housing, which comprises a heating block formed with at least one electrical heating element, said heating block having a surface in contact with said porous medium that is formed with a plurality of concentric grooves and at least one radial groove interconnecting said concentric grooves, wherein the outermost one of said concentric grooves is formed with a vapor discharge exit to permit the escape of generated vapor.

2. A vapor generator as claimed in claim 1 wherein said heating element comprises at least one cartridge heater.

3. A vapor generator as claimed in claim 2 wherein means are provided for controlling said electrical heating element whereby upon operation said element is firstly run at a high power rating, and is then run at a lower power rating.

4. A vapor generator as claimed in claim 1 wherein said heating element comprises a planar film heater.

5. A vapor generator as claimed in claim 4 wherein means are provided for controlling said electrical heating element whereby upon operation said element is firstly run at a high power rating, and is then run at a lower power rating.

6. A vapor generator as claimed in claim 1 wherein the porous medium extends for a height less than the full height of the housing leaving a chamber underneath the porous medium for the supply of liquid thereto.

7. A vapor generator as claimed in claim 6 wherein means are provided for controlling the supply of liquid to said reservoir.

8. A vapor generator as claimed in claim 7 wherein said liquid supply control means comprises a control valve located in a supply line to said reservoir, a water level sensor for sensing the water level in said reservoir, and control means for controlling said valve in response to an output from said sensor.

9. A vapor generator as claimed in claim 1 wherein the porous medium extends for the full height of the housing and the liquid is supplied via a feed pipe extending into the porous medium.

10. A vapor generator as claimed in claim 9 wherein means are provided for controlling the supply of liquid to said reservoir.

11. A vapor generator as claimed in claim 1 wherein means are provided for controlling said electrical heating element whereby upon operation said element is firstly run at a high power rating, and is then run at a lower power rating.

12. A vapor generator as claimed in claim 1 wherein a lower end of said housing is located within said liquid reservoir.

* * * * *